United States Patent [19]

Scott

[11] Patent Number: 4,660,502

[45] Date of Patent: Apr. 28, 1987

[54] PASTE APPLICATING APPARATUS FOR WALL COVERING SHEET

[76] Inventor: Thomas J. Scott, 16615 Wolfridge, San Antonio, Tex. 78247

[21] Appl. No.: 888,658

[22] Filed: Jul. 23, 1986

[51] Int. Cl.[4] ..... B05C 3/18

[52] U.S. Cl. ..... 118/415; 118/413; 118/429; 118/DIG. 17

[58] Field of Search ..... 118/415, DIG. 17, 413, 118/429

[56] References Cited

U.S. PATENT DOCUMENTS

| | | | |
|---|---|---|---|
| D. 262,352 | 12/1981 | Fullerton et al. | 118/DIG. 17 |
| 1,725,261 | 8/1929 | Ernst | 118/415 |
| 3,389,680 | 6/1968 | Moore | 118/415 X |
| 4,554,886 | 11/1985 | Carter | 118/415 X |

*Primary Examiner*—John P. McIntosh

*Attorney, Agent, or Firm*—Norvell & Associates

[57] ABSTRACT

An elongated paste containing box is provided having a shaft supporting a roll of wall covering sheet adjacent the rear face of the rear wall of the box. A bottom wall is pivoted for vertical movement relative to the bottom edge of the front wall of the box and is spaced from the bottom edge of the rear wall of the box so that a sheet of wall covering can be passed through the bottom of the box on the bottom wall and in contact with a body of adhesive paste contained therein. A linkage for applying a compressive force to opposite ends of the bottom wall is provided to permit a desired bow in the bottom wall to be produced and thus maintain the bottom wall in a desired, vertically spaced relationship to the front wall of the box to obtain either a uniform or a desired non-uniform deposit of paste from one lateral edge to the other lateral edge of the wall covering sheet passing through the box.

10 Claims, 6 Drawing Figures

PASTE APPLICATING APPARATUS FOR WALL COVERING SHEET

BACKGROUND OF THE INVENTION

FIELD OF THE INVENTION

The invention relates to a paste applicating box for applying adhesive-type paste to the rear face of wall covering sheets.

SUMMARY OF THE PRIOR ART

Paste applicating boxes for wall covering have been known in the prior art for many years. All of such paste applicating boxes provide apertures between the top surface of the bottom wall and the bottom edges of the front and rear walls to permit a wall covering sheet to be passed therethrough and to contact the body of adhesive paste contained in the box. Typical of such arrangements are U.S. Pat. Nos. 1,033,282; 1,084,825; 3,389,680; 3,496,909; 4,159,695; and 4,554,886.

A sealing gasket is generally provided in such prior art boxes in depending relationship to the rear wall of the box. A wiper gasket is secured in depending relationship to the bottom edge of the front wall of the box and the vertical position of the bottom edge of the wiper determines the thickness of the paste coating supplied to the wall covering sheet.

For many years, wall covering sheets were of limited width on the order of 18–24 inches. In recent years, the practice has developed of manufacturing some wall covering sheets in widths of from 48–60 inches. Obviously, the width of the paste applicating box has to be substantially increased to accommodate the increased width of the wall covering sheets. Since the paste applicating box has to carried from job to job, it is obviously desirable for the benefit of the workmen utilizing such box, to have it manufactured in as light a weight design as is possible. As a result, most boxes have been fabricated either from wood or relatively light gage aluminum components. Because of this light weight construction, the bottom wall is inherently deformable, particularly when the weight of the entire body of adhesive paste contained in the box is applied to the bottom wall through the adhesive sheet passing over the bottom wall. As a result, the bottom walls of elongated paste applicating boxes have been subject to serious bowing of the bottom wall which results in an uneven application of paste across the width of the wall covering sheet; i.e., too much paste in the center of the sheet and too little adjacent the edges. If sufficient reinforcement is applied to the bottom wall to eliminate the bowing, then the resulting box is quite heavy and difficult to transport.

There is, therefore, a serious deficiency existing in paste applicating boxes heretofore utilized in the prior art, which is particularly evident when such boxes are designed for applying an adhesive paste to a relatively wide wall covering sheet.

SUMMARY OF THE INVENTION

The invention provides a paste applicating box of generally rectangular configuration having opposed, generally vertical, elongated back and front walls interconnected by relatively short side walls. An elongated bottom wall is provided which underlies the back, front and side walls and is pivotally secured to either the back or the side walls so that the front edge of the bottom wall may be adjustably vertically positioned relative to the bottom edge of the front wall of the box. A gasket is provided in depending relationship to the rear wall and snugly engages the top surface of the wall covering sheet passing over the bottom wall through the box so as to prevent the leakage of adhesive paste beneath the rear wall. A wiper-type gasket is secured in depending relationship to the bottom edge of the front wall and defines a predetermined opening between its bottom edge and the top surface of the wall covering sheet, thus determining the thickness of the paste layer that is carried by the sheet out of the box. Means are provided for adjusting the vertical position of the opposed edges of the bottom wall of the box relative to the front wall so as to permit the adjustment of the thickness of the paste applied to the wall covering sheet.

The bottom wall is preferably formed from wood or wood encased in a light gage non-corrosive metal, such as galvanized steel, or from aluminum. Because of such light weight construction, and particularly because the width of the paste applicating box is ordinarily on the order of 48–60 inches, the bottom wall of the box is inherently subject to bowing due to the weight of the adhesive paste in the box which is supported thereon during the paste applicating operation. To overcome this inherent bow of the bottom wall, means are provided for applying a compressive force between opposite side edges of the bottom wall. Such compressive force may, for example, be provided by a pair of rods having their outer ends anchored to the bottom wall of the paste applicating box adjacent to the lateral edges of such bottom wall and their inner ends threaded to receive a turnbuckle, which is then tightened on such threaded portions to the degree necessary to eliminate the inherent bow produced in the bottom wall of the paste applicating box. If desired, a reverse bow can be produced in the bottom wall, resulting in a heavier paste layer on the edges of the sheet than in the center.

The paste applicating box embodying this invention further incorporates on the inner face of each of the front and rear walls, a longitudinally extending track, which are disposed in opposed, parallel relationship. A sheet of relatively flexible material, such as Plexiglass, is slid into such grooves to provide a second bottom for the box which may conveniently be utilized during the starting or the termination of the paste applicating operations to confine the paste to the upper portions of the box while the initial or final portions of the wall covering sheet are being passed through the bottom of the box.

Further objects and advantages of this invention will become readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
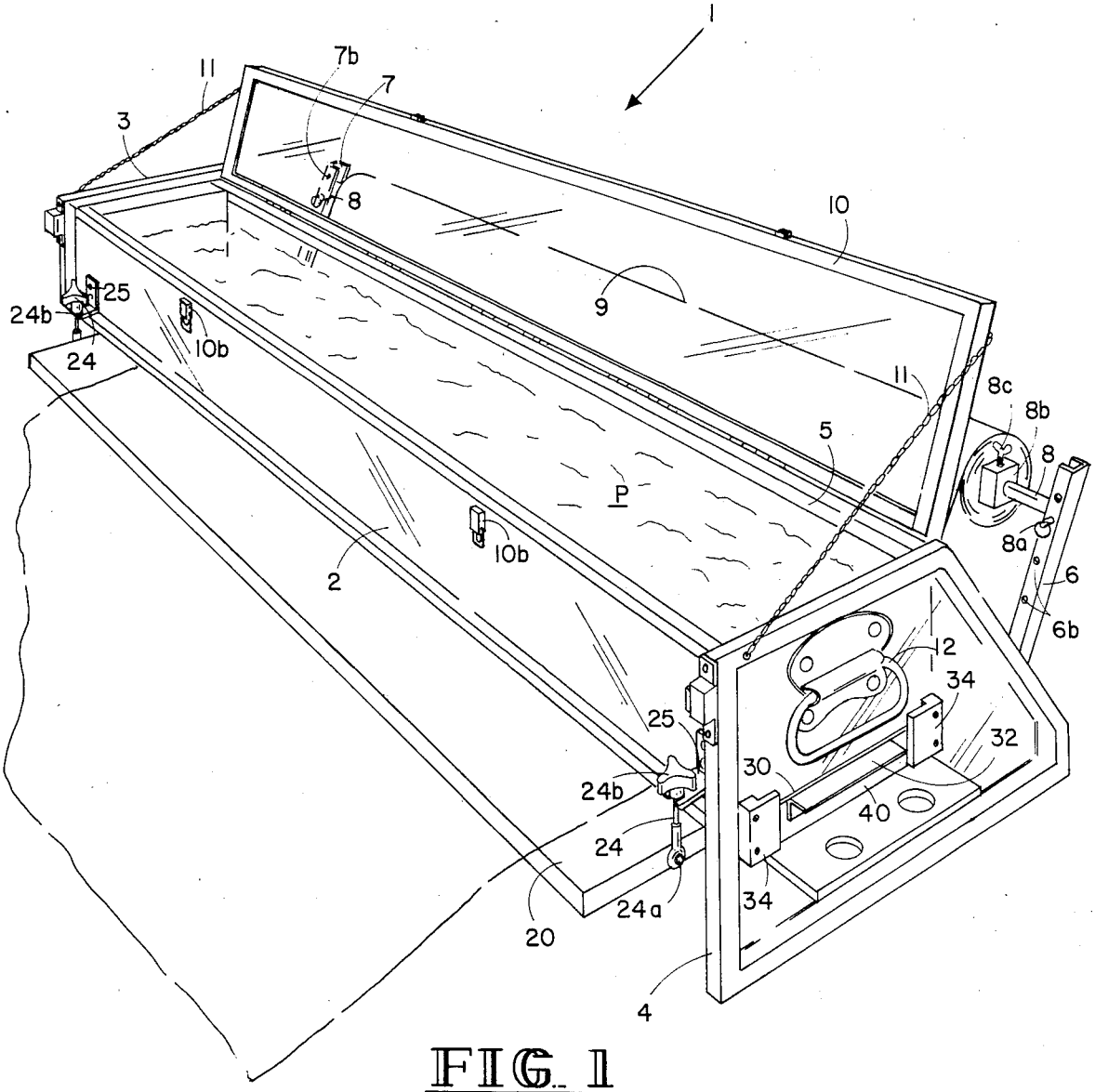
FIG. 1 is a perspective view of a paste applicating apparatus embodying this invention.

A paste applicating apparatus 1 embodying this invention comprises an elongated, generally rectangular box formed by the rigid assemblage of a vertical front wall 2, two side walls 3 and 4, and a generally vertical rear wall 5. Each of the side walls 3 and 4 extend downwardly beyond the lower extremities of the front wall 2 and the rear wall 5 and thus function as supports for the box structure which can be mounted on any type of table or a sheet of plywood supported by spaced saw horses (not shown). All such walls are preferably fabricated from transparent plastic.

Upwardly and rearwardly extending roll support bars 6 and 7 are respectively bolted to side walls 3 and 4 by bolts 6*a* and 7*a*. The roll support members 6 and 7 are both of channel shaped configuration and are provided with a plurality of transverse holes 6*b* and 7*b*. A roll support shaft 8 has its ends disposed within the channels within the channel shaped support arms 6 and 7 and is secured in any selected position through inserting a pin 8*a* through appropriate aligned holes 6*b* and 7*b* provided in the roll support bars 6 and 7. Thus, a roll of wall covering 9 may be rotatably positioned on the apparatus by having the shaft 8 inserted through the bore of such roll and the roll secured against lateral movement by blocks 8*b* mounted on the shaft 8 adjacent each end of the roll 9 and secured in position by thumb screws 8*c*.

A top wall or cover 10 is provided for the paste box defined by walls 2, 3, 4 and 5. Cover 10 may be fabricated of a transparent plastic. Cover 10 is secured by a piano hinge 10*a* to the top of rear wall 5 and is shown in its open position in FIG. 1 and in its closed position in FIG. 3. In its closed position, cover 10 may be secured by a pair of latches 10*b* mounted in spaced relationship along the outer face of the front wall 2. A pair of chains 11 secured to the top forward portions of side walls 3 and 4 and to the unsecured corner portions of the cover wall 10 prevent the cover wall from pivoting back in so far that it would interfere with the roll of wall covering 9. A pair of handles 12 are secured to the top portions of side walls 3 and 4 to permit the convenient transport of the paste applicating apparatus 1.

Figure 2:
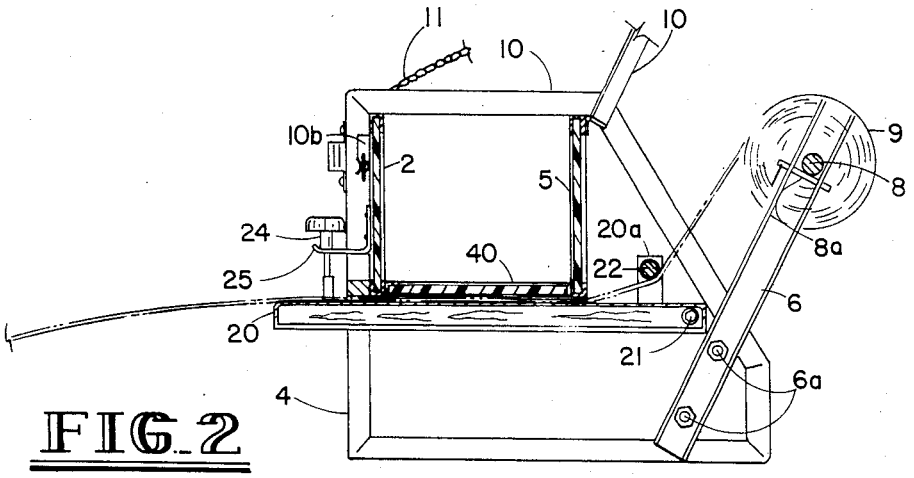
FIG. 2 is a vertical sectional view taken on the plane 2—2 of FIG. 1.

The bottom wall 20 for the paste applicating apparatus 1 is mounted for pivotal movement relative to the fixed front, rear and side walls. Bottom wall 20 is preferably mounted on pivot bolts 21 which in turn are mounted in the lower, rear portions of side walls 3 and 4, so that bottom wall 20, as shown in FIG. 2, can be pivotally moved to a substantially horizontal position immediately beneath the front and rear walls 2 and 3. A guide bar 22 for the sheet material contained in the roll 9 is mounted on upstanding brackets 20*a* and 20*b* provided on opposed lateral edges of the bottom wall 20.

Figure 6:
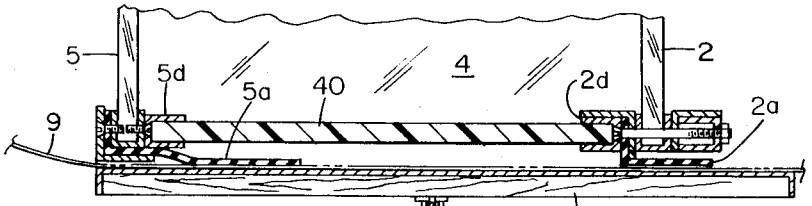
FIG. 6 is an enlarged scale, partial sectional view taken on the plane 6—6 of FIG. 2.

As best seen in the enlarged scale view of FIG. 6, an elastomeric, horizontally extending gasket 5*a* is suitably secured to the bottom edge of rear wall 5 and thus sealingly engages the top surface of the sheet fed through the apparatus from the roll 9. In similar fashion, a elastomeric wiper gasket 2*a* is secured to the bottom edge of the interior face of the front wall 2 and projects rearwardly in overlying relation to the top surface of the sheet material 9. The bottom edge of the wiper 2*a* does not, however, actually engage the sheet material but is spaced a slight distance thereabove corresponding to the desired thickness of paste to be applied to the wall covering sheet 9. The exact spacing between the top surface of the bottom wall 20 and the wiper 2*a* is determined by a pair of adjustable links 24 which are respectively pivotally secured to the side edges of the bottom wall 20 by bolts 24*a* and terminates with threaded knobs 24*b*. The links 24 are respectively received in horizontal slots (not shown) provided in a pair of brackets 25 respectively mounted on the outer face of the front wall 2. Thus, by tightening the knobs 24*b*, the exact vertical position of the bottom wall 20 relative to the wiper 2*a* may be selectively adjusted. If desired, gaskets (not shown) may also be applied to the bottom edges of side walls 3 and 4.

As will be understood by those skilled in the art, the leading edge of the sheet material 9 to which paste is to be applied is fed through the apparatus lying on top of the top surface of the bottom wall 20, as best shown in FIG. 2. The enclosure defined by the front wall 2, side walls 3 and 4, rear wall 5 is then filled with a flowable adhesive paste P. The forward edge of the sheet material 9 is then pulled through the box and a layer of the adhesive paste 30 will be deposited thereon with the thickness of the layer being determined by the spacing between the elastomeric wiper 2*a* and the top surface of the bottom wall 20.

For the apparatus 1 to be successfully employed with all of the available widths of wall covering that are currently utilized, the apparatus 1 must have a transverse width in the range of 48–60 inches. Additionally, since the location of each wall covering job has to change daily if not hourly, it is essential that the paste applicating apparatus 1 be constructed with as little weight as possible. For this reason, the bottom wall is preferably fabricated from wood or light gage aluminum. In the preferred embodiment of the invention, the wood forms the interior core of such wall member which is encased within a covering of galvanized steel or sheet aluminum. Because of the light weight construction, the bottom wall 20 is inherently subject to deformation when a load of paste P is inserted in the paste applicating apparatus 1, so that it tends to assume a bowed configuration with the center of the bottom wall being displaced a greater distance downwardly relative to the wiper 2*a* than the two edges thereof. This would then result in the layer of adhesive paste being thicker in the center of the sheet than at the edges of the sheet and this is exactly the opposite of what is desirable. Many paper hangers prefer a uniform application of paste across the width of the sheet, but still others prefer a slightly heavier application of paste adjacent the edge portions of the sheet. Neither of these desirable results can be achieved unless the bottom wall 20 is rendered sufficiently rigid so as to resist any deformation, and this, of course, results in a substantial increase in the weight of the paste applicating apparatus 1.

Figure 3:
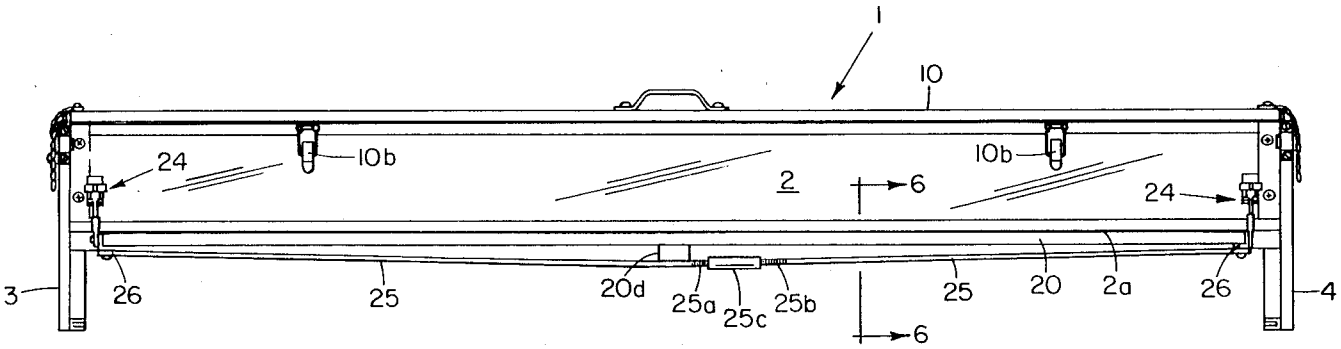
FIG. 3 is a reduced scale, front elevational view of FIG. 1.
Figure 4:
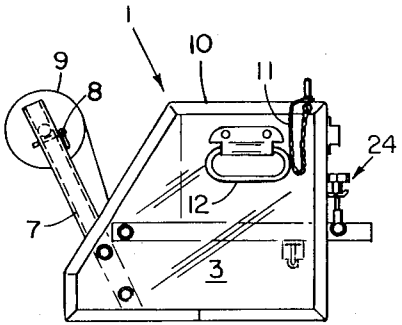
FIG. 4 is a left side elevational view of FIG. 1.

Referring now to FIG. 3, this invention contemplates applying a compressive force to opposite end portions of the bottom wall 20 so as to neutralize any bow produced in such bottom wall by the weight of the paste P. Such compressive force may, for example, be applied through the anchoring of a pair of rods 25 to brackets 26 respectively secured to opposite end portions of the bottom face of the bottom wall 20. The other ends of rod portions 25 are reversely threaded as indicated at 25*a* and 25*b*, and a turnbuckle 25*c* is engaged with such threaded ends so that the rods 25 may be readily placed in tension by the threading action of the turnbuckle 25*c* and thus impart a compressive force to the bottom wall 20 which will thus impart a compressive force to the bottom wall 20 which will eliminate any bow therein. To facilitate the elimination of the bow, and permit a reverse bow to be provided, if desired, one of the rods 25 is spaced from the bottom surface of bottom wall 20 by a depending bracket 20*d*.

Through the application of such compressive force, the vertical configuration of the bottom wall 20 may be adjusted to make the bottom wall exactly parallel to the bottom edge of the wiper 2*a*, thus producing a uniform layer of paste across the width of the wall covering sheet. Alternatively, the compressive force may be applied to a degree sufficient to produce a reverse bowing of the bottom wall 20 and this would result in the adhesive paste layer being thicker at the edges of the wall covering sheet than at the center. In either case, a more distribution of the adhesive paste across the width of the wall covering sheet is obtained.

A further feature of this invention lies in the provision of means for quickly and conveniently terminating the flow of adhesive paste to the wall covering sheet. As best shown in FIG. 6, the inner face of the front wall 2 and the inner face of the rear wall 5 are each provided with elongated U-shaped tracks 2*d* and 5*d* respectively adjacent their bottom edges. These tracks are aligned with an aperture 30 in at least one of the side walls 3 or 4 and permits the insertion of a flexible sheet 40 to function as a second bottom for the paste enclosure and thus interrupt the flow of paste through the apparatus. Aperture 30 is closed by a slide 32 inserted in brackets 34 secured to the outer face of side wall 4 to prevent paste leakage when flexible sheet 40 is not inserted in the paste box. Thus, at the completion of the application of paste to a desired length of the wall covering sheet 9, the insertion of the flexible second bottom element 40 will cut off the flow of paste and permit the paste applicating operation to be terminated without requiring that all of the paste be dumped from the paste applicating box.

While not limited thereto, the flexible second bottom sheet 40 may preferably be formed from a commercially available material known as "Plexiglass", but any reasonably flexible plastic or metal may be employed as the second bottom element merely by sliding same into the opposed tracks 2*d* and 5*d* provided in the front wall 2 and the rear wall 5.

Figure 5:
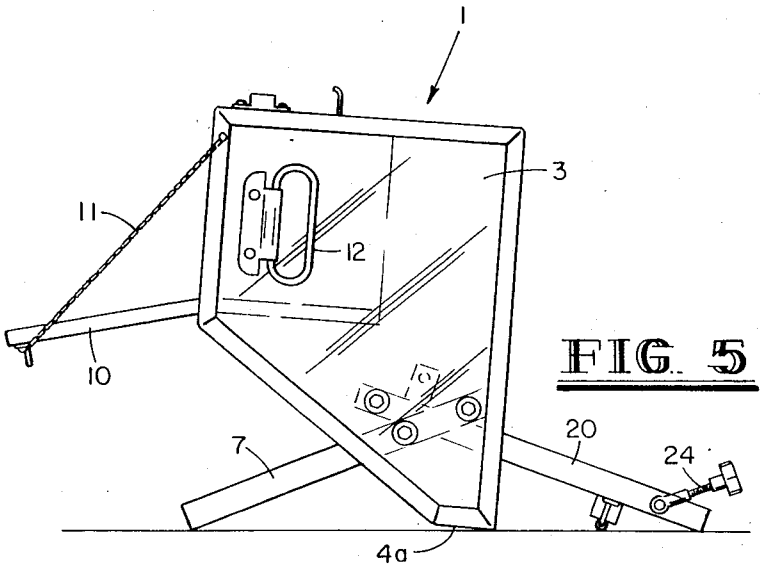
FIG. 5 is a view illustrating the manner of opening the paste application apparatus of FIG. 1 for cleaning purposes.

A further advantageous feature of the paste applicating apparatus embodying this invention lies in its susceptibility to thorough cleaning through the application of water from a garden hose or the like. As shown in FIG. 5, the apparatus 1 may be tilted so as to lie on the short vertical wall portions 4*a* and 5*a* of the side walls 4 and 5 and in that position, the box will be supported by the extreme forward edge of the bottom wall 20, and by the top end of the roll support bars 6 and 7. By opening the top wall 10 and permitting it to hang from the chains 11, the entire interior of the paste applicating apparatus 1 is exposed and can be reached by water spray from a hose and thus be quickly and thoroughly cleaned.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent:

1. Apparatus for applying a controlled thickness layer of flowable adhesive paste to the back of a sheet of wall covering, comprising, in combination: a generally rectangular box having elongated back and front walls rigidly interconnected by opposed side walls; an elongated, deformable bottom wall underlying said back, front and side walls, means for mounting said bottom wall for pivotal movement about a horizontal axis adjacent to the bottom edge of said rear wall to provide a substantially constant width opening between the bottom edge of said rear wall and the top surface of said bottom wall; thereby permitting a sheet of wall covering to be drawn through said box from the back to the front with its back surface uppermost and disposed in overlying relation to said bottom wall, whereby paste introduced into said box contacts the back surface of the wall covering as it is pulled through said box; gasket means depending from said back wall to engage the top surface of said wall covering sheet and prevent leakage of paste; wiper means depending from the bottom edge of said front wall to overly the front portions of said bottom wall; means for adjusting the vertical position of said front portions of said bottom wall relative to said wiper means; and means for controlling the vertical sag of the front edge of said deformable bottom wall to maintain a preselected spacing between the bottom edge of said wiper means and said front portions of said bottom wall to permit the passage of said wall covering sheet out of said box with a preselected thickness distribution of paste thereon.

2. The apparatus of claim 1 further comprising opposed horizontal tracks in the internal faces of said front and rear walls; said grooves being disposed above said bottom wall; and a false bottom slidably inserted in said tracks to prevent downward flow of adhesive paste, thereby facilitating starting and stopping of the paste application operation.

3. The combination defined in claim 1 or 2 wherein said means for controlling the vertical sag of said elongated, deformable bottom wall comprises means secured to the bottom surface of said bottom wall adjacent each end thereof for applying a compressive force thereto, thereby reducing any vertical sag in said elongated, deformable bottom wall.

4. The combination defined in claim 1 or 2 wherein said means for controlling the vertical sag of said elongated, deformable bottom wall comprises a pair of rods respectively having one end anchored to the bottom surface of said bottom wall adjacent one end thereof; and a turnbuckle threadably secured to the other ends of said rods, whereby tightening said turnbuckle imposes a longitudinal compressive stress on said elongated, deformable bottom wall to reduce any vertical sag thereof.

5. The apparatus of claim 1 or 2 further comprising means for supporting a roll of wall covering sheet material in parallel, adjacent relationship to the rear face of said rear wall.

6. Apparatus for applying a controlled thickness layer of flowable adhesive paste to the back of a sheet of wall covering, comprising, in combination: a generally rectangular box having elongated back and front walls rigidly interconnected by opposed side walls; an elongated, deformable bottom wall underlying said back, front and side walls, means for mounting said bottom wall for pivotal movement about a horizontal axis adjacent to the bottom edge of said rear wall to provide a substantially constant width opening between the bottom edge of said rear wall and the top surface of said bottom wall; thereby permitting a sheet of wall covering to be drawn through said box from the back to the front with its back surface uppermost and disposed in overlying relation to said bottom wall, whereby paste introduced into said box contacts the back surface of the wall covering as it is pulled through said box; means for adjusting the vertical position of said front portions of said bottom wall relative to the bottom of said front wall; and means for reducing the vertical bow of the front edge of said deformable bottom wall to maintain a substantially constant spacing between the bottom of said front wall and said front portions of said bottom wall to permit the passage of said wall covering sheet out of said box with a preselected lateral thickness distribution of paste thereon.

7. The apparatus of claim 6 further comprising opposed horizontal tracks on the internal faces of said front and rear walls; said tracks being disposed immediately above said bottom wall; and a false bottom slidably inserted in said tracks to prevent downward flow of adhesive paste, thereby facilitating starting and stopping of the paste application operation.

8. The combination defined in claims 6 or 7 wherein said means for controlling the vertical sag of said elongated, deformable bottom wall comprises means secured to the bottom surface of said bottom wall adjacent each end thereof for applying a compressive force thereto, thereby reducing any vertical sag in said elongated, deformable bottom wall.

9. The combination defined in claims 6 or 7 wherein said means for controlling the vertical sag of said elongated, deformable bottom wall comprises a pair of rods respectively having one end anchored to the bottom surface of said bottom wall adjacent one end thereof; and a turnbuckle threadably secured to the other ends of said rods, whereby tightening said turnbuckle imposes a longitudinal compressive stress on said elongated, deformable bottom wall to reduce any vertical sag thereof.

10. Apparatus for applying a controlled thickness layer of flowable adhesive paste to the back of a sheet of wall covering, comprising, in combination: a generally rectangular box having elongated back and front walls rigidly interconnected by opposed side walls; an elongated, bottom wall underlying said back, front and side walls, means for mounting said bottom wall for pivotal movement about a horizontal axis adjacent to the bottom edge of said rear wall to provide a substantially constant width opening between the bottom edge of said rear wall and the top surface of said bottom wall; thereby permitting a sheet of wall covering to be drawn through said box from the back to the front with its back surface uppermost and disposed in overlying relation to said bottom wall, whereby paste introduced into said box contacts the back surface of the wall covering as it is pulled through said box; means for adjusting the vertical position of said front portions of said bottom wall relative to the bottom of said front wall; opposed horizontal tracks on the internal faces of said front and rear walls; said tracks being disposed immediately above said bottom wall; and a false bottom slidably inserted in said tracks to prevent downward flow of adhesive paste, thereby facilitating starting and stopping of the paste application operation.

* * * * *